US009373458B2

(12) United States Patent
Welke et al.

(10) Patent No.: US 9,373,458 B2
(45) Date of Patent: Jun. 21, 2016

(54) HAND-HELD POWER TOOL

(75) Inventors: Joerg Welke, Ettlingen-Schoellbronn (DE); Dietmar Saur, Gomaringen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 12/837,197

(22) Filed: Jul. 15, 2010

(65) Prior Publication Data

US 2011/0011610 A1 Jan. 20, 2011

(30) Foreign Application Priority Data

Jul. 15, 2009 (DE) ..... 10 2009 027 705

(51) Int. Cl.

| | |
|---|---|
| ***B23B 45/00*** | (2006.01) |
| ***E21B 3/00*** | (2006.01) |
| ***H01H 9/06*** | (2006.01) |
| ***H01H 15/00*** | (2006.01) |
| ***B25B 21/00*** | (2006.01) |
| ***B25F 5/00*** | (2006.01) |

(52) U.S. Cl.

CPC ..... *H01H 9/063* (2013.01); *B25B 21/00* (2013.01); *B25F 5/00* (2013.01)

(58) Field of Classification Search

CPC ..... H01H 9/063; H01H 13/08; H01H 2011/0075; H02K 23/66; H02K 7/145; H02K 17/30; H02K 11/0073; A47J 43/082

USPC ..... 173/47, 170, 213, 217, 176–180, 216, 173/218; 310/68 A; 200/547–550

See application file for complete search history.

(56) References Cited

U.S. PATENT DOCUMENTS

| | | | | |
|---|---|---|---|---|
| 3,260,827 | A * | 7/1966 | Frenzel | 200/522 |
| 3,467,801 | A * | 9/1969 | Matthews | 200/1 V |
| 3,579,002 | A * | 5/1971 | Wickham | 310/50 |
| 3,632,936 | A * | 1/1972 | Piber | 200/1 V |
| 3,703,646 | A | 11/1972 | Janyco | |
| 6,206,107 | B1 * | 3/2001 | Wadge | 173/217 |
| 7,401,663 | B2 * | 7/2008 | Craven et al. | 173/217 |
| 7,594,549 | B2 * | 9/2009 | Hua | 173/104 |
| 7,861,796 | B2 * | 1/2011 | DeCicco et al. | 173/1 |
| 2005/0006217 | A1 | 1/2005 | Bader et al. | |
| 2008/0251269 | A1 | 10/2008 | Hua | |
| 2008/0271906 | A1 * | 11/2008 | Walker | 173/216 |
| 2010/0031781 | A1 * | 2/2010 | Ito et al. | 81/57.4 |
| 2010/0263895 | A1 * | 10/2010 | Bosch | 173/217 |

FOREIGN PATENT DOCUMENTS

| | | | |
|---|---|---|---|
| CN | 101300111 | | 11/2008 |
| DE | 3342412 | A1 | 6/1985 |
| DE | 10212721 | A1 | 9/2002 |
| JP | 1246083 | A | 10/1989 |

(Continued)

*Primary Examiner* — Stephen F Gerrity
*Assistant Examiner* — Eyamindae Jallow
(74) *Attorney, Agent, or Firm* — Norton Rose Fulbright US LLP

(57) ABSTRACT

In a hand-held power tool with a device for presetting a selected rotation direction of a drive motor that is associated with the power tool and contained in a tool housing. The device is equipped with an actuating element accessible from outside the tool housing for mechanically actuating a switch element, which is situated inside the tool housing and is at least embodied for electrically switching between a first and second rotation direction of the drive motor, the switch element is situated in the vicinity of the actuating element.

16 Claims, 2 Drawing Sheets

(56) References Cited

FOREIGN PATENT DOCUMENTS

| | | | |
|---|---|---|---|
| JP | 10202554 | A | 8/1998 |
| JP | 2002154073 | | 5/2002 |
| JP | 2002154073 | A | 5/2002 |
| JP | 2006231494 | A | 9/2006 |

* cited by examiner

HAND-HELD POWER TOOL

CROSS-REFERENCE TO RELATED APPLICATION

This application is based on German Patent Application 10 2009 027 705.6 filed Jul. 15, 2009.

BACKGROUND OF THE INVENTION

1. Field of the Invention

The present invention relates to a hand-held power tool with a device for presetting a selected rotation direction of a drive motor that is associated with the power tool and contained in a tool housing; the device has an actuating element accessible from outside the tool housing for mechanically actuating a switch element, which is situated inside the tool housing and is at least embodied for electrically switching between a first and second rotation direction of the drive motor.

2. Description of the Prior Art

Hand-held power tools of this kind are known from the prior art in which a corresponding actuating element is connected to a suitable switch element via an associated transmission element. As a rule, the transmission element is a rod assembly that mechanically transmits an actuation of the actuating element to the associated switch element.

One disadvantage of the prior art is that as a rule, this rod assembly has only a limited ruggedness and is thus susceptible to malfunction. In addition, a rod assembly of this kind, accompanied by levers associated with it, increases the forces that act on the switch element. Moreover, power tools of this kind require a significant amount of space.

OBJECT AND SUMMARY OF THE INVENTION

The object of the invention, therefore, is to create a novel hand-held power tool with a compact, rugged embodiment.

This object is attained by a hand-held power tool with a device for presetting a selected rotation direction of a drive motor that is associated with the power tool and contained in a tool housing. The device has an actuating element accessible from outside the tool housing for mechanically actuating a switch element, which is situated inside the tool housing and is at least embodied for electrically switching between a first and second rotation direction of the drive motor. The switch element is situated in the vicinity of the actuating element.

The invention consequently enables the creation of a hand-held power tool in which the placement of the switch element in the vicinity of the actuating element makes it possible to reduce the amount of space required for the power tool, thus enabling a more compact embodiment.

According to one embodiment, the actuating element has a receiving element in which the switch element is at least partially accommodated.

It is thus possible to achieve a further reduction of the space required for the power tool, with a comparatively short overall height and length.

The receiving element is preferably embodied to trigger a switching of the switch element when the actuating element is actuated.

The invention thus enables the creation of a simple, inexpensive actuating element.

The switch element is preferably provided with a slider for the switching, which is at least partially accommodated in the receiving element.

It is thus possible to achieve a safe, reliable cooperation of the actuating element and switch element.

According to one embodiment, the slider is detachably fastened to a holding element embodied on the receiving element.

The invention thus enables a simple, reliable connection of the actuating element to the switch element, making it possible to create a short tolerance chain, rendering the use of a complex, malfunction-prone, tolerance-encumbered transmission element unnecessary.

The holding element has at least one first and one second rib-like protrusion, with the slider being at least partially accommodated between the first and second protrusions.

It is thus possible to produce a rugged, inexpensive holding element for the actuating element.

The switch element is preferably fastened to a circuit board provided in the tool housing.

The switch element can thus be accommodated in a secure, stable fashion in the tool housing.

According to one embodiment, the tool housing has at least one opening through which the actuating element protrudes in a way that allows it to be actuated from outside the tool housing.

The invention thus enables a simple, rugged transmission of force as the actuating element is being actuated.

The actuating element preferably has a blocking element that is embodied to prevent the actuating element from being actuated during operation of the power tool.

It is thus possible through simple means to safely and reliably prevent an unwanted reversal of the rotation direction during operation of the power tool.

According to one embodiment, the power tool has a manual switch for switching the drive motor on and off; the manual switch is provided with a stop element that is embodied to block the blocking element in a selected preset rotation direction during operation of the power tool.

It is thus possible to achieve a simple, inexpensive blocking function to prevent an unwanted reversal of the rotation direction during operation of the power tool.

Preferably, the device is supported on the tool housing.

It is thus possible to achieve a simple, inexpensive embodiment of the power tool.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
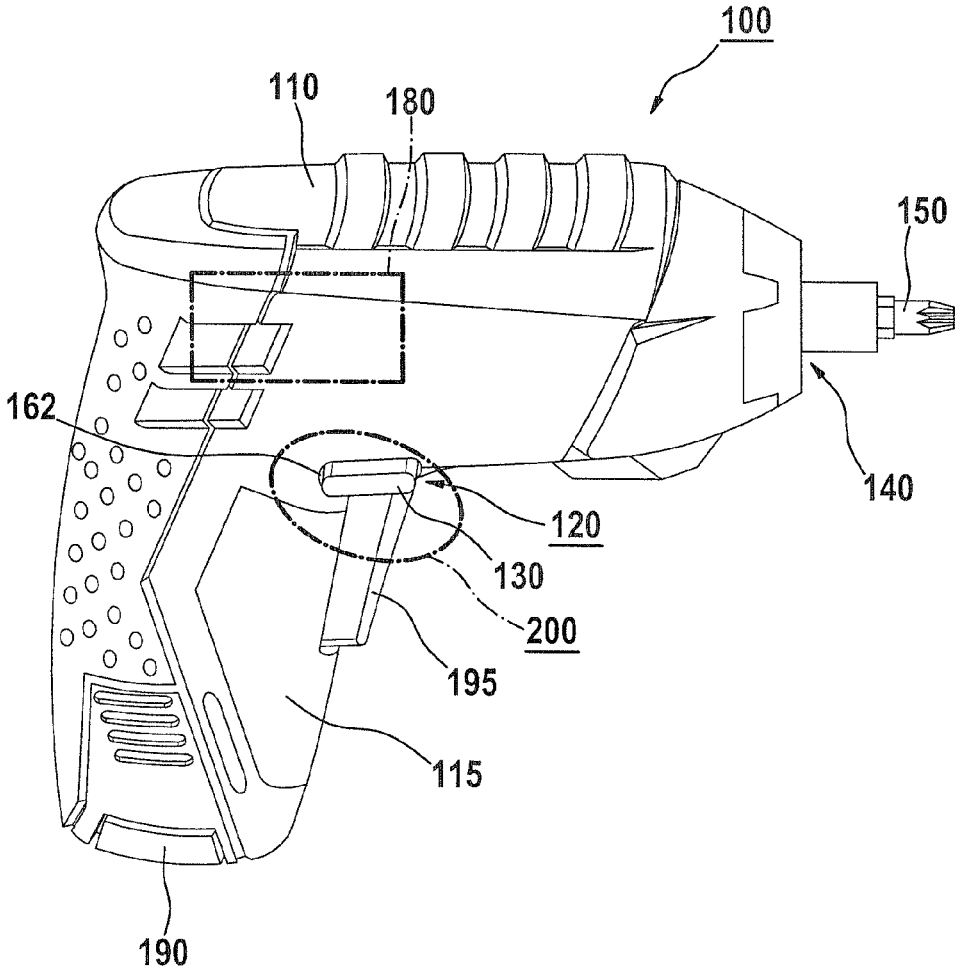
FIG. 1 is a perspective view of a first embodiment of a hand-held power tool.

FIG. 1 shows an example of a hand-held power tool 100, which has a tool housing 110 with a handle 115. According to one embodiment, to enable a supply of current independent of the power grid, the power tool 100 can be mechanically and electrically connected to a battery pack 190 and is equipped, for example, with a tool holder 140 for holding a tool 150. In FIG. 1, the power tool 100 is embodied for example in the form of a cordless screwdriver. It should be noted, however, that the present invention is not limited to cordless screwdrivers, but can instead be used in various battery-operated power tools such as a cordless drill/driver, a cordless impact drill, etc. as well as in corded power tools.

The tool housing 110 contains an electric drive motor 180 supplied with current by the battery pack 190 and a device 120 for presetting a selected rotation direction of the drive motor 180. The motor 180 can be situated directly in the tool housing 110, or—for example in order to protect it from dust and dirt—can be situated in a separate motor housing, with the motor housing being supported in the tool housing 110. The drive motor 180, which is only depicted schematically in FIG. 1, can for example be actuated, i.e. switched on and off, by means of a manual switch 195 and can be any type of motor that can be operated in reverse mode, such as an electronically or mechanically commutated motor or a DC motor. Preferably, the drive motor 180 can be controlled and/or regulated electronically so that it is possible not only to implement the reverse mode, but also to execute presetting actions with regard to a desired rotation speed. The operating mode and design of a suitable drive motor are sufficiently known from the prior art, permitting omission of a detailed description here for the sake of brevity.

According to one embodiment, the device 120 for presetting a selected rotation direction of the drive motor 180 has an actuating element 130 that is accessible from outside the tool housing 110. Preferably, the tool housing 110 has at least one first opening 162 through which a first axial end region of the actuating element 130 protrudes, permitting it to be actuated from outside the tool housing 110 in order, for example, to allow a user of the power tool 100 to slide it transversely relative to the longitudinal span of the power tool 100 in order to preset a selected rotation direction. The device 120 will be described in detail below with reference to a side view of an enlarged detail 200 shown in FIG. 2.

Figure 2:
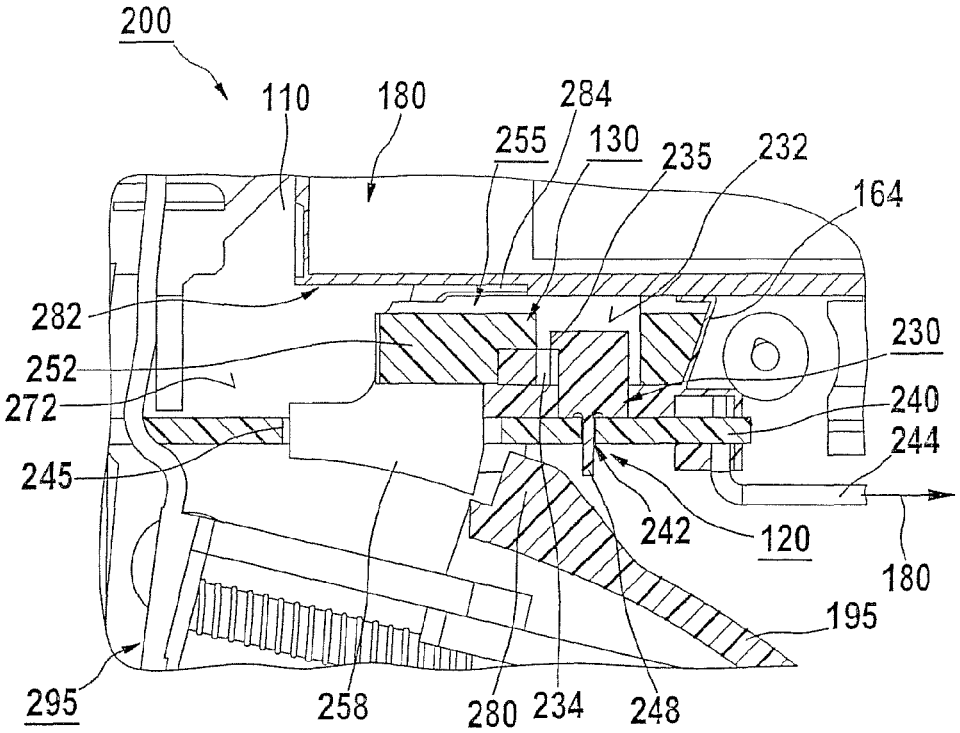
FIG. 2 is an enlarged, sectional view of a detail of the power tool from FIG. 1.

FIG. 2 shows the detail 200 of the hand-held power tool 100 from FIG. 1, in which the drive motor 180 is situated, for example, in an associated motor housing 282. The detail 200 shows an exemplary embodiment of the manual switch 195 and the device 120 for presetting a selected rotation direction. For example, the manual switch 195 is supported in the tool housing 110 by means of an associated mechanism 295. This mechanism 295 can, for example, be embodied in a way known from the prior art.

FIG. 2 also shows a second opening 164 in the tool housing 110, through which a second axial end region of the actuating element 130 of the device 120 protrudes in such a way that the actuating element 130 can be actuated from outside the tool housing 110, as described above in conjunction with FIG. 1. Preferably, the actuating element 130 is supported in the tool housing 110 by means of the openings 164, 162 (FIG. 1).

According to one embodiment, the actuating element 130 is embodied for mechanically actuating a switch element 230 that is situated in the vicinity of the actuating element 130. The switch element 230 is preferably situated entirely inside the tool housing 110, i.e. enclosed by the tool housing 110, and is embodied for electrically reversing between a first and second rotation direction of the drive motor 180. It should be noted, however, that the reversal between the first and second rotation direction is only described by way of example and does not constitute a limitation of the invention. Instead, it is alternatively possible, through cooperation of the actuating element 130 and switch element 230, to also produce other switch states. For example, in a modification of the invention, the drive motor 180 can be switched between a clockwise rotation, a counterclockwise rotation, and an idle mode by actuating the actuating element 130.

For example, the actuating element 130 has a receiving element 232 in which the switch element 230 is at least partially accommodated. This receiving element 232 is preferably embodied to trigger a switching of the switch element 230, as described below, when the actuating element 130 is actuated.

In FIG. 2, the receiving element 232 is embodied for example in the form of a recess or opening, which is provided in the actuating element 130 and in which the switch element 230 is situated. It should be noted, however, that the depicted embodiment of the receiving element 232 does not constitute a limitation of the invention. For example, the receiving element 232 can generally be embodied as trough-shaped, with an arbitrarily predefinable trough depth. Alternatively, the receiving element 232 can also be embodied in the form of a connecting element for connecting to the switch element 230, as described below in conjunction with the example of a holding element 255, so that the switch element 230 merely rests against the actuating element 130, forming an air gap that can be freely dimensioned.

According to one embodiment, the switch element 230 is fastened to a circuit board 240 that is mounted in the tool housing 110 by means of suitable fastening means. For example, the switch element 230 has a pin-like fastening element 248, which is inserted through an opening 242 of the circuit board 240 and fastened to the circuit board 240, e.g. by being press-fitted, glued, soldered, or wired using the SMD technique. It should be noted, however, that the fastening of the switch element 230 to a circuit board 240 provided in the tool housing 180 does not constitute a limitation of the invention. Instead, the switch element 230 can be fastened in the housing 110 in various ways, e.g. directly to an inside of the housing 272.

By means of a line 244 fastened to the circuit board 240, the switch element 230 is connected to the drive motor 180 and/or to associated motor electronics in order to send the latter a switching state that is preset in a rotation direction reversal. Such a rotation direction reversal and its execution by means of a slide switch in a power tool is sufficiently known from the prior art, thus permitting omission of a detailed description here for the sake of brevity.

For example, the switch element 230 is embodied as a slide switch, one longitudinal side 235 of which is provided with a switch lever preferably embodied in the form of a slider 234. It can, for example, be slid into different positions in the longitudinal direction of the switch element 230 that are associated with a counterclockwise rotation, a clockwise rotation, and an idle mode. The slider 234 is secured by a holding element 255 embodied on the receiving element 232 of the actuating element 130. For example, the holding element 255 has a first and second rib-like protrusion 252, 254 (FIG. 3), with the slider 234 at least partially accommodated between them. This permits a transmission of force to the tool housing 110; an excessive pressure on the slider 234 can be prevented by providing a stop 284 for the holding element 255 on the tool housing 110, for example. Alternatively, the stop 284 for the slider 234 can be constituted, for example, by the switch element 230 or the circuit board 240.

According to one embodiment, the actuating element 130 has a blocking element 258. For example, this blocking element is a wedge-like rib that reaches through a cut-out 245 provided in the circuit board 240. The blocking element 258 is embodied to block an actuation of the actuating element 130 during operation of the power tool 100 in order to prevent an unwanted reversal of the rotation direction during operation of the tool 100 and thus to avoid a possible damage to the drive motor 180. To this end, the blocking element 258 can be brought into an operative engagement with a stop element 280 provided on the manual switch 195. For example, this stop element is embodied in the form of a shark fin and is used to block the blocking element 258 in a respectively selected preset rotation direction during operation of the power tool 100.

During operation of the power tool 100 from FIG. 1, a desired rotation direction of the drive motor 180 is preset by actuating the actuating element 130. For example, the actuating element 130 in FIG. 2 has been slid into its position the furthest to the left relative to the longitudinal span of the tool housing 110, i.e. down into the plane of the drawing in FIG. 2; this position is associated with a rotation direction preset for a counterclockwise rotation of the drive motor 180. When the manual switch 195 is actuated, the shark fin-like stop element 280 slides in front of the wedge-shaped blocking element 258 in the perspective view shown in FIG. 2, so that when the actuating element 130 is actuated to carry out a switch, e.g. into clockwise rotation, i.e. is moved transversely relative to the longitudinal span of the tool housing 110 and up out from the plane of the drawing in FIG. 2, the blocking element 258 strikes against the stop element 280 and is thus blocked.

When the drive motor 180 is at a stop, if the actuating element 130 is then slid into its position the furthest to the right relative to the longitudinal span of the tool housing 110, i.e. is moved up out from the plane of the drawing in FIG. 2, in order to preset a clockwise rotation for the drive motor 180, then when the manual switch 195 is actuated, the shark fin-like stop element 280 slides behind the wedge-like blocking element 258 in the perspective view shown in FIG. 2 so that when the actuating element 130 is actuated in order to switch e.g. into the counterclockwise rotation, i.e. is moved transversely relative to the longitudinal span of the tool housing 110, down into the plane of the drawing in FIG. 2, this blocking element 258 strikes against the stop element 280 and is thus blocked.

Figure 3:
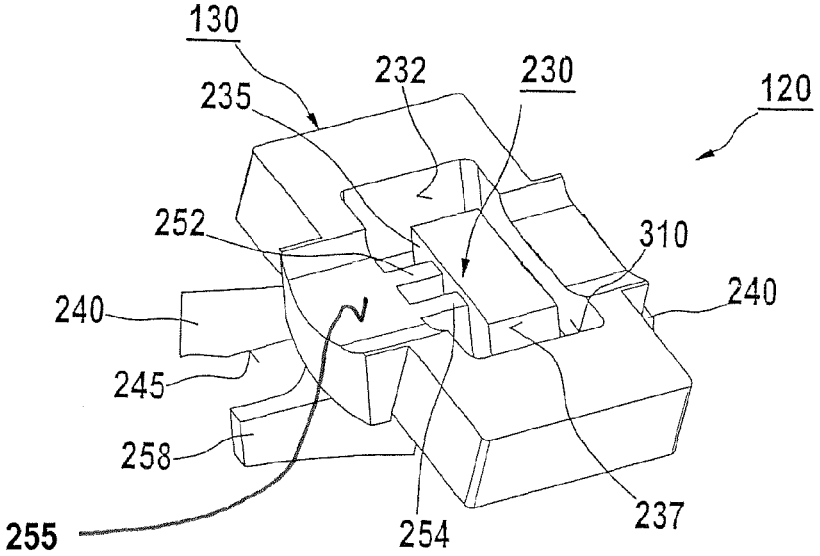
FIG. 3 is an enlarged, perspective view of the actuating element from FIG. 2 and the switch element connected to it.

FIG. 3 shows the actuating element 130 from FIGS. 1 and 2 connected to the switch element 230 from FIG. 2. FIG. 3 shows an embodiment in which the receiving element 232 is embodied for example as a central opening in the actuating element 130 in which the switch element 230 is entirely accommodated. This permits a very compact implementation of the device 120 with a minimal overall height.

According to one embodiment, the switch element 230 has a push button, a slider, or a contactless switch on at least one end surface 237. This button, slider, or switch can be actuated with a sliding of the actuating element 130, e.g. by means of an associated inner wall 310 of the receiving element 232. Consequently, in lieu of the slide switch described in conjunction with FIG. 2, it is also possible, for example, to use a pressure switch. In this case, a switching between clockwise and counterclockwise rotation can be carried out by means of a single push button provided on the end surface 237 or by means of push buttons provided on both end surfaces of the pressure switch.

FIG. 3 also illustrates an embodiment of the holding element 255 of the actuating element 130 that is preferably formed into the recess in the actuating element 130, which recess constitutes the receiving element 232; in this embodiment, the actuating element 130 is equipped with the first and second rib-like protrusions 252 and 254, between which the slider 234 from FIG. 2 is at least partially accommodated. According to one embodiment, the slider 234 is detachably fastened to the holding element 255, i.e. is press-fitted between the rib-like protrusions 252, 254 or engages there in detent fashion. Alternatively, it is also possible to use a fixed attachment, e.g. produced by means of gluing or welding.

The foregoing relates to preferred exemplary embodiments of the invention, it being understood that other variants and embodiments thereof are possible within the spirit and scope of the invention, the latter being defined by the appended claims.

We claim:

1. A hand-held power tool with a device for presetting a selected rotation direction of a drive motor that is associated with the power tool and contained in a tool housing, the device comprising an actuating element accessible from outside the tool housing, the tool housing having at least a first opening through which a first axial end region of the actuating element protrudes and a second opening through which a second axial end region of the actuating element protrudes, which actuating element is linearly slidable in a transverse direction relative to the longitudinal span of the power tool for mechanically actuating a slider that is associated with a switch element, which switch element is situated inside the tool housing and is at least embodied for electrically switching between a first and second rotation direction of the drive motor, wherein the actuating element has a central recess or opening in which the switch element is at least partially accommodated, wherein the actuating element has a holding element which protrudes into the central recess or opening and is configured to releasably connect the slider such that the slider is at least partially accommodated in the central recess or opening.

2. The power tool as recited in claim 1, wherein the central recess or opening is embodied to trigger a switching of the switch element when the actuating element is actuated.

3. The power tool as recited in claim 2, wherein the slider is adapted from the switching and is at least partially accommodated in the central recess or opening.

4. The power tool as recited in claim 3, wherein the slider is detachably fastened to the holding element embodied on the central recess or opening.

5. The power tool as recited in claim 4, wherein the holding element has at least one first rib-like protrusion and one second rib-like protrusion and the slider is at least partially accommodated between the first and second protrusions.

6. The power tool as recited in claim 3, wherein the switch element is fastened to a circuit board provided in the tool housing.

7. The power tool as recited in claim 1, wherein the slider is adapted for the switching and is at least partially accommodated in the central recess or opening.

8. The power tool as recited in claim 7, wherein the slider is detachably fastened to the holding element embodied on the central recess or opening.

9. The power tool as recited in claim 8, wherein the holding element has at least one first rib-like protrusion and one second rib-like protrusion and the slider is at least partially accommodated between the first and second protrusions.

10. The power tool as recited in claim 7, wherein the switch element is fastened to a circuit board provided in the tool housing.

11. The power tool as recited in claim 7, wherein the actuating element has a blocking element that is embodied to prevent the actuating element from being actuated during operation of the power tool.

12. The power tool as recited in claim 11, further comprising a manual switch for switching the drive motor on and off, the manual switch provided with a stop element that is embodied to block the blocking element in a selected preset rotation direction during operation of the power tool.

13. The power tool as recited in claim 1, wherein the switch element is fastened to a circuit board provided in the tool housing.

14. The power tool as recited in claim 1, wherein the actuating element has a blocking element that is embodied to prevent the actuating element from being actuated during operation of the power tool.

15. The power tool as recited in claim 14, further comprising a manual switch for switching the drive motor on and off, the manual switch provided with a stop element that is embodied to block the blocking element in a selected preset rotation direction during operation of the power tool.

16. The power tool as recited in claim 1, wherein the device is supported on the tool housing.

* * * * *